US008727803B2

(12) United States Patent
Kurachi

(10) Patent No.: US 8,727,803 B2
(45) Date of Patent: May 20, 2014

(54) ELECTRIC CONNECTOR HAVING A FITTED STATE WITH A MATING CONNECTOR HELD BY A FIT-TURNING ARM

(75) Inventor: Takaki Kurachi, Tokyo (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 60 days.

(21) Appl. No.: 13/395,456

(22) PCT Filed: Aug. 1, 2011

(86) PCT No.: PCT/JP2011/067599

§ 371 (c)(1),
(2), (4) Date: Mar. 12, 2012

(87) PCT Pub. No.: WO2012/017983

PCT Pub. Date: Feb. 9, 2012

(65) Prior Publication Data

US 2012/0171890 A1 Jul. 5, 2012

(30) Foreign Application Priority Data

Aug. 2, 2010 (JP) ..... 2010-173592

(51) Int. Cl.
*H01R 12/24* (2006.01)

(52) U.S. Cl.
USPC ..... 439/497; 439/607.47

(58) Field of Classification Search
USPC ..... 439/607.41–607.49, 607.35, 607.4, 439/372, 579, 495–498
See application file for complete search history.

(56) References Cited

U.S. PATENT DOCUMENTS

| | | | | |
|---|---|---|---|---|
| 6,749,458 | B1 * | 6/2004 | Kuo et al. | 439/484 |
| 6,830,478 | B1 * | 12/2004 | Ko | 439/579 |
| 7,094,092 | B2 * | 8/2006 | Yang | 439/495 |
| 7,927,122 | B2 * | 4/2011 | Yamaji et al. | 439/342 |
| 7,931,493 | B2 * | 4/2011 | Cheng | 439/497 |
| 8,075,324 | B2 * | 12/2011 | Yamaji et al. | 439/188 |
| 8,241,065 | B2 * | 8/2012 | Ikari et al. | 439/607.41 |
| 8,388,370 | B2 * | 3/2013 | Yamaji et al. | 439/497 |

FOREIGN PATENT DOCUMENTS

| | | |
|---|---|---|
| JP | 62 178469 | 11/1987 |
| JP | 2009 193916 | 8/2009 |
| JP | 2010 67378 | 3/2010 |
| JP | 2010 146761 | 7/2010 |

OTHER PUBLICATIONS

International Search Report Issued Sep. 20, 2011 in PCT/JP11/67599 Filed Aug. 1, 2011.

* cited by examiner

*Primary Examiner* — Thanh Tam Le
(74) *Attorney, Agent, or Firm* — Oblon, Spivak, McClelland, Maier & Neustadt, L.L.P.

(57) ABSTRACT

A cam portion is provided at a turning shaft portion of a fit-turning arm which holds a fitted state of a connector with a mating connector, a cam-biasing device is provided on a connector main body, and the fit-turning arm is made hard to depart from a "fit-acting position" by applying a turning biasing force to the cam portion in a direction of holding the fit-turning arm which has been turned to the "fit-acting position" at the "fit-acting position".

6 Claims, 13 Drawing Sheets

(a)

(b)

(a)

(b)

ELECTRIC CONNECTOR HAVING A FITTED STATE WITH A MATING CONNECTOR HELD BY A FIT-TURNING ARM

BACKGROUND OF THE INVENTION

1. Field of the Invention

The present invention relates to an electric connector configured such that its fitting state with a mating connector is held by a fit-turning arm.

2. Description of the Related Art

For electrically connecting a plurality of relatively thin cables or a relatively small-sized FPC to a main base board such as a solid printed-wiring board attached with various electric parts, such a configuration that a mating connector (a plug connector or the like) coupled with a plurality of cables or an FPC is fitted to an electric connector (a receptacle connector or the like) on the base board side which is attached to and electrically connected to the main base board in a plug-in manner is widely adopted. As described in Japanese Utility Model Application Laid-Open publication No. 62-178469, in order to hold a fitting state of a connector with a mating connector excellently, a fit-turning arm turnably attached to a connector main body is provided, and both the connectors are put in a coupled state to each other by turning the fit-turning arm to a fit-acting position, so that detachment of both the connectors from each other is prevented.

Thus, when the fit-turning arm is turned to the fit-acting position, the fit-turning arm is positioned by a proper reception portion, but there is conventionally such a case that a backlash occurs in a positioned state of the fit-turning arm located at the fit-acting position. Further, in such a case that unexpected load is applied to the fit-turning arm, there is a possibility that the fit-turning arm departs from the reception portion of the connector main body. Thus, in the conventional electric connector provided with the fit-turning arm, the held state of the fit-turning arm becomes unstable, so that there is a possibility that the fitted state of both the connectors cannot be maintained excellently.

SUMMARY OF THE INVENTION

In view of these circumstances, an object of the present invention is to provide an electric connector which can maintain a fitted state thereof with a mating connector excellently via a fit-turning arm with a simple configuration.

In order to achieve the above object, according to the present invention, there is provided an electric connector which is configured such that turning shaft portions of a fit-turning arm are turnably attached to both side end portions of bearing portions of a connector main portion where a conductive shell is attached to an insulating housing, and when a mating connector is fitted to the connector main body, a fitting state with the mating connector is held by turning the fit-turning arm to a fit-acting position, wherein cam portions turning approximately concentrically with the turning shaft portions are provided on the turning shaft portions of the fit-turning arm, cam-biasing devices which come in pressure-contact with the cam portions to bias the fit-turning arm in a turning manner are provided on the connector main body, and the cam-biasing devices biases the cam portions in a turning manner in a direction of moving the fit-turning arm toward the fit-acting position.

According to such a configuration, when the fit-turning arm is turned toward the fit-acting position, turn-biasing forces directed from the cam-biasing devices toward the fit-acting position via the cam portions are applied to the fit-turning arm and the fit-turning arm which has been turned to the fit-acting position becomes hard to depart from the fit-acting position, so that the fitted state of both the connectors is maintained excellently.

Further, in the fit-acting position, since the biasing forces from the cam portions are applied in an operation direction of the fit-turning arm, a worker can obtain a clicking feeling, so that workability is improved.

Further, it is desirable that the cam portions in this invention are formed integrally with the turning shaft portions of the fit-turning arm by deforming end portions, in an axial direction, of the turning shaft portions of the fit-turning arm concentrically in a twisting manner.

According to such a configuration, production of the cam portions can be performed efficiently by only imparting a simple step to the fit-turning arm.

Further, in the present invention, it is desirable that the cam-biasing devices have pressing plates, each made of a resilient plate-shaped member, and the pressing plates are disposed to be capable of being brought into pressure-contact with portions of the cam portions.

According to such a configuration, it becomes possible to adopt a simple configuration in the cam-biasing devices.

Further, in the present invention, it is desirable that the pressing plates configuring the cam-biasing devices are provided integrally with the conductive shell configuring the connector main body.

According to such a configuration, the cam-biasing devices are manufactured together with the conductive shell efficiently, and they can be easily and precisely positioned to the cam portion on the basis of the conductive shell.

In the present invention, it is desirable that supporting shafts formed so as to project from end faces of the cam portions approximately concentrically therewith and having diameters at least smaller than those of the cam portions are provided on the cam portions, and the supporting shafts are turnably held by the connector main body.

According to such a configuration, since the cam portions and the fit-turning arm are stably turned about the supporting shafts and bearing portions holding the supporting shafts formed to have diameters smaller than those of the cam portions can be formed small, size reduction of the electric connector can be achieved.

In the present invention, it is desirable that an engagement lock portion holds the fit-turning arm which has been turned to the fit-acting position at the fit-acting position is provided on the mating connector.

According to such a configuration, since in addition to the holding action of the fit-turning arm obtained from the cam-biasing devices and the cam portions, a holding action of the engagement lock portion is imparted to the fit-acting position, the fit-turning arm is held at the fit-acting position more securely.

In the present invention, it is possible to provide, on the fit-turning arm, a conductive cover which covers the connector main body and the mating connector when the fit-turning arm has been turned to the fit-acting position.

According to such a configuration, the conductive cover itself covers the connection main portion and the mating connector so that an electromagnetic shield function of the electric connector is enhanced during usage thereof, and rigidity of the whole fit-turning arm is increased. As a result, the turning operation of the fit-turning arm is performed stably.

As described above, since the present invention is configured such that when the fit-turning arm holding the fitted state with the mating connector has been turned to the fit-acting position, the turn-biasing forces from the cam-biasing devices are applied to the fit-turning arm in the direction of the fit-acting position via the cam portions and the fit-turning arm becomes hard to depart from the fit-acting position, so that the fitted state of both the connectors is maintained excellently, the fitted state with the mating connector can be maintained excellently by the fit-turning arm, and reliability of the electric connector can be considerably enhanced with a simple configuration.

DETAILED DESCRIPTION OF THE PREFERRED EMBODIMENTS

Figure 1:
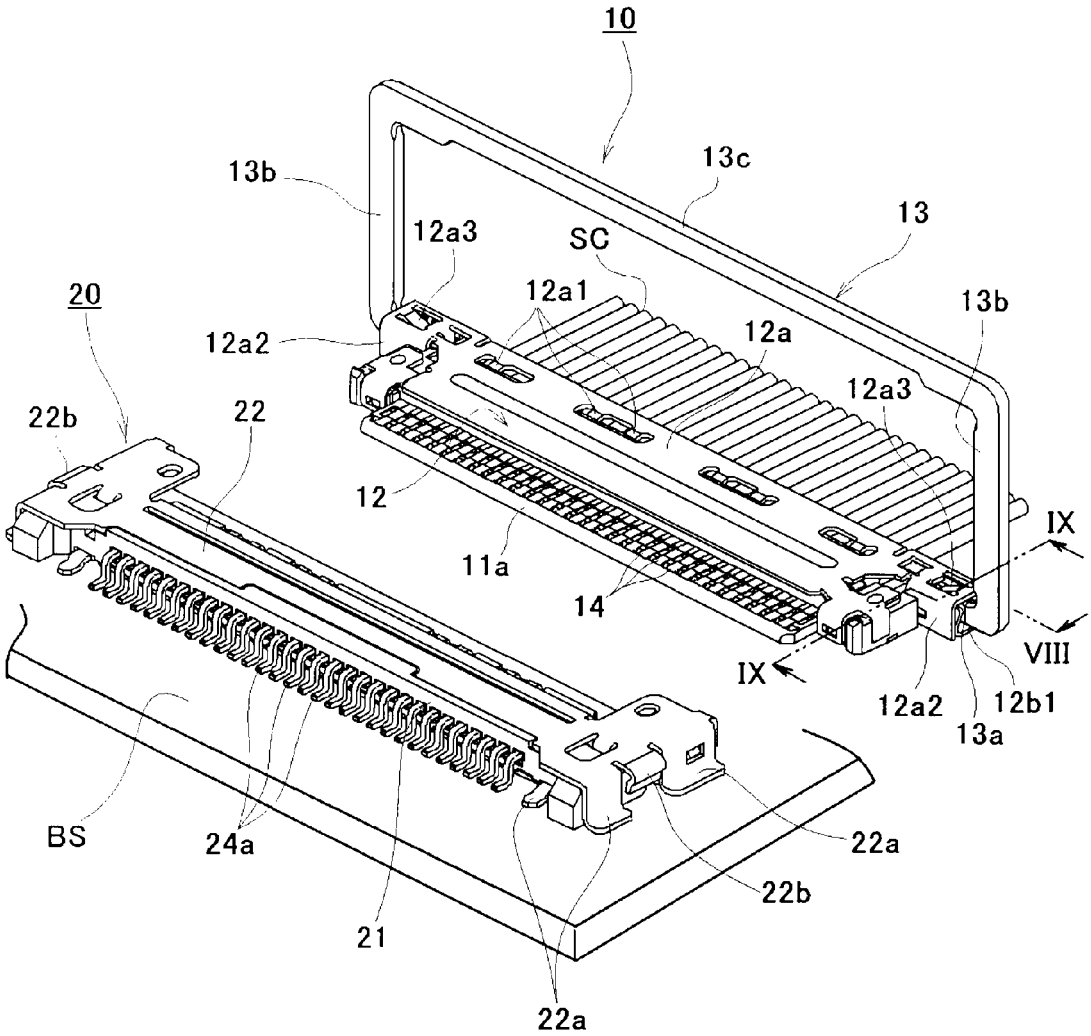
FIG. 1 is an appearance perspective explanatory view showing a state where a plug connector according to an embodiment of the present invention has been caused to come close to a receptacle connector as a mating connector.

Embodiments of the present invention will be explained below in detail with reference to the drawings.

[Regarding Electric Connector Assembly]

An electric connector assembly according to an embodiment of the present invention shown in FIG. 1 to FIG. 10 is one for connecting thin coaxial cables SC serving as a signal transmission medium to a printed-wiring board BS and it is configured such that a plug connector 10 serving as an electric connector according to the present invention coupled with terminal portions of the thin coaxial cables SC has been inserted and fitted into a receptacle connector 20 serving as a mating connector and soldered to a wiring pattern formed on the printed-wiring board BS approximately horizontally.

In the following, an extension direction of a surface of the printed-wiring board BS is defined as "horizontal direction", while a direction perpendicular to the surface of the printed-wiring board BS is defined as "height direction". Further, in the plug connector 10, an end edge portion thereof in an inserting direction at a fitting time is defined as "front end edge portion", while an end edge portion thereof opposite thereto is defined as "rear end edge portion", and in the receptacle connector 20, an end edge portion thereof on the side where the plug connector 10 is inserted at the fitting time is defined as "front end edge portion", while an end edge portion thereof on the opposite side is defined as "rear end edge portion".

The plug connector 10 and the receptacle connector 20 extend in one direction in an elongated manner, and the elongated extension direction is defined as "connector-longitudinal direction". At this time, the above-described thin coaxial cables SC have such a configuration that a plurality of coaxial cables is arranged adjacent to one another along the "connector-elongated direction" in a multipolar manner.

[Regarding Plug Connector]

A connector main body of the plug connector 10 configuring one electric connector in such an electric connector assembly has an insulating housing 11 formed of insulating material such as synthetic resin and it is provided with upper and lower conductive shells 12*a* and 12*b* which cover an outer surface of the insulating housing 11 to shield external electromagnetic noise or the like. That is, the conductive shell along with the insulating housing 11 configuring the connector main body is composed of the upper conductive shell 12*a* and the lower conductive shell 12*b* attached so as to sandwich the insulating housing 11 from above and underneath, and a fit-turning arm 13 which holds a fitted state with the receptacle connector 20 as the mating connector via bearing portions described later is turnably attached to both end portions of the conductive shell in the connector-longitudinal direction.

Similarly, a plurality of conductive contacts 14 are arranged in the insulating housing 11 configuring the connector main body along the connector-longitudinal direction in a multipolar manner at proper pitch intervals. The respective conductive contacts 14 are formed by bending metal materials as shown in FIG. 6A, and they are arranged to extend on an upper surface of the insulating housing 11 backward and forward. The respective conductive contacts 14 in this embodiment are formed such that adjacent ones have approximately the same shape.

On the other hand, the above-described thin coaxial cable (signal transmission medium) SC is electrically connected to a rear end portion (a right end portion in FIG. GA) of each conductive contact 14. That is, each thin coaxial cable SC is configured such that an outer conductor for grounding SC2 encloses an outer periphery of a central conductor for signal transmission SC1 concentrically, and it is preliminarily formed to have such a structure that a terminal portion of the thin coaxial cable SC is skinned so that an exposed state is obtained and the central conductor SC1 projects from the outer conductor SC2 forward. The central conductor SC1 of the central conductor SC1 and the outer conductor SC2 is placed on the rear end portion (the right end portion in FIG. 6A) of the conductive contact 14 from above and soldering is performed in such a contact arrangement state. Soldering at this time is performed to all members in a multipolar arrangement direction collectively.

A pair of ground bars SC3 and SC3 are arranged to come contact with the outer conductors SC2 of the above-described thin coaxial cables (signal transmission medium) SC so as to sandwich the outer conductors SC2 from above and underneath. The respective ground bars SC3 are formed of thin plate-like metal members extending in the connector-longitudinal direction, and they are collectively soldered to all the outer conductors SC2 arranged in a multipolar manner. Such an arrangement relationship is adopted that respective portions of the upper conductive shell 12*a* and the lower conductive shell 12*b* come in contact with the respective ground bars SC3, respectively, and for example, contact spring portions 12*a*1 formed on an upper face portion of the upper conductive shell 12*a* in a cantilever tongue shape resiliently come in contact with a surface of the ground bar SC3.

A fit-protrusion portion 11*a* inserted into the receptacle connector 20 configuring a fitting mate is provided on a front end edge portion of the above-described insulating housing 11 so as to extend along the connector-longitudinal direction in a thin plate state. When the fit-protrusion portion 11*a* of the plug connector 10 has been inserted into the receptacle connector 20 configuring the fitting mate (see FIG. 6B), the front end edge portion of the upper conductive shell 12*a* on the plug connector 10 side comes in plane-contact with the upper face side of a conductive shell 22 on the receptacle connector 20 side and the front end edge portion of the lower conductive shell 12*b* on the plug connector 10 side comes in plane-contact with the lower face side of the conductive shell 22 on the receptacle connector 20 side, so that a ground circuit for grounding is formed by contact between both the conductive shells, as described later. The conductive shell 22 of the receptacle connector 20 will be explained later.

The fit-protrusion portion 11*a* provided at the front end edge portion of the insulating housing 11 is provided to extend along the connector-longitudinal direction in a thin-plate state, and front end portions (a left end portion in FIG. 6A) of the above-described conductive contacts 14 are arranged on an upper face of the fit-protrusion portion 11*a* in a multiple-electrode state. When the plug connector 10 has been fitted to the receptacle connector 20 (see FIG. 6B), the front end portions of the conductive contacts 14 are resiliently brought into contact with conductive contacts 23 on the receptacle connector 20 side described later, so that a signal transmission circuit is formed.

Figure 4:
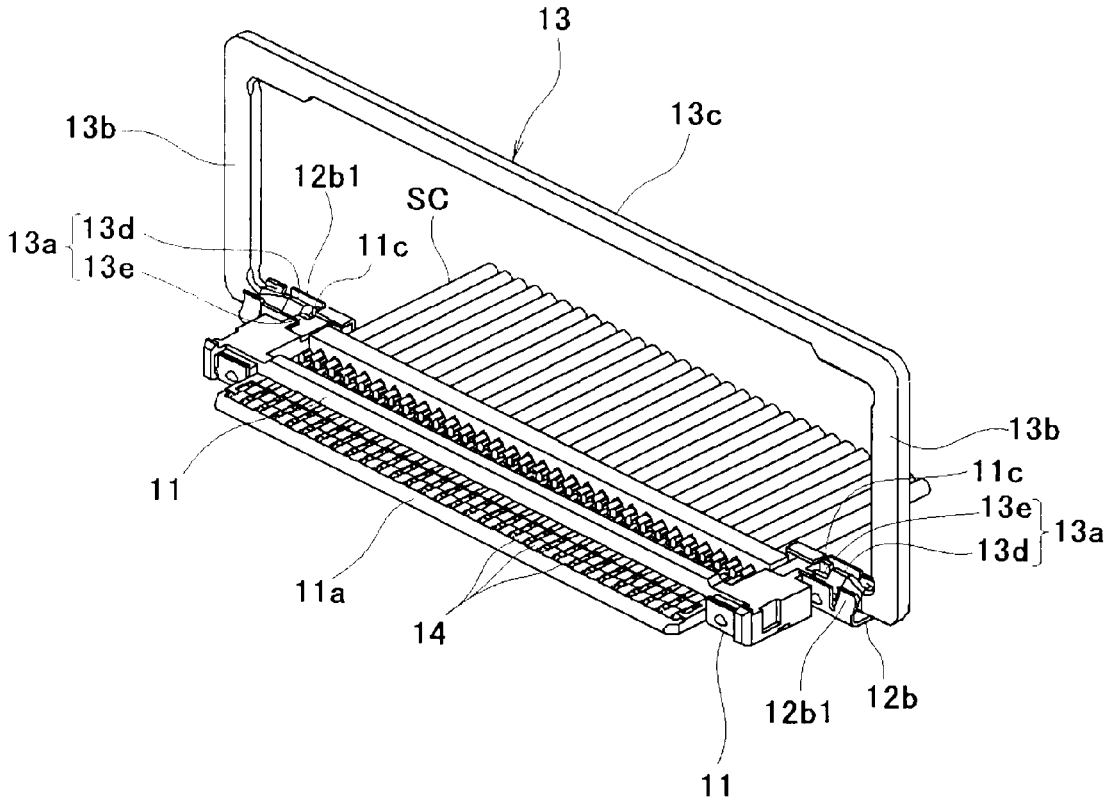
FIG. 4 is an appearance perspective explanatory view showing the state of the plug connector alone shown in FIG. 1 and further showing a state where a conductive shell on an upper side has been removed.
Figure 5:
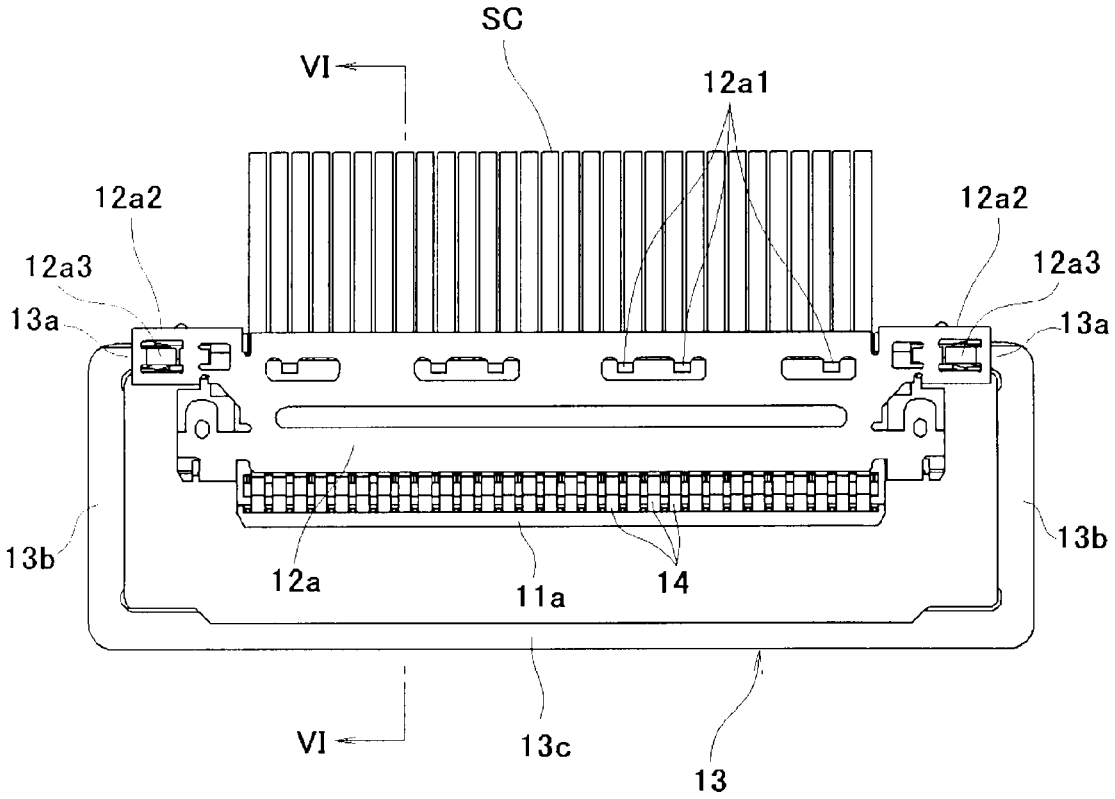
FIG. 5 is a plan explanatory view showing the state of the plug connector alone shown in FIG. 1 and further showing a state where the fit-turning arm has been turned to the fit-acting position.
Figure 6:
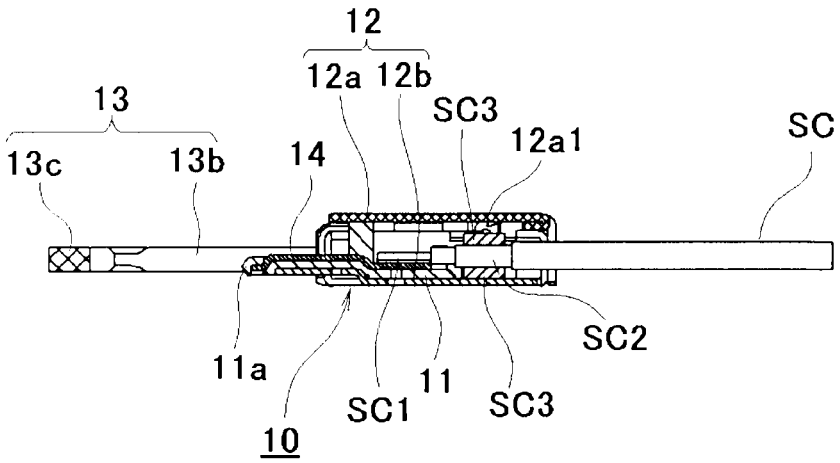
FIG. 6A is a cross-sectional explanatory view of the plug connector alone taken along line VI-VI in FIG. 5.
FIG. 6B is a cross-sectional explanatory view showing a state where the receptacle connector has been fitted to the plug connector shown in FIG. 6A.
Figure 6:
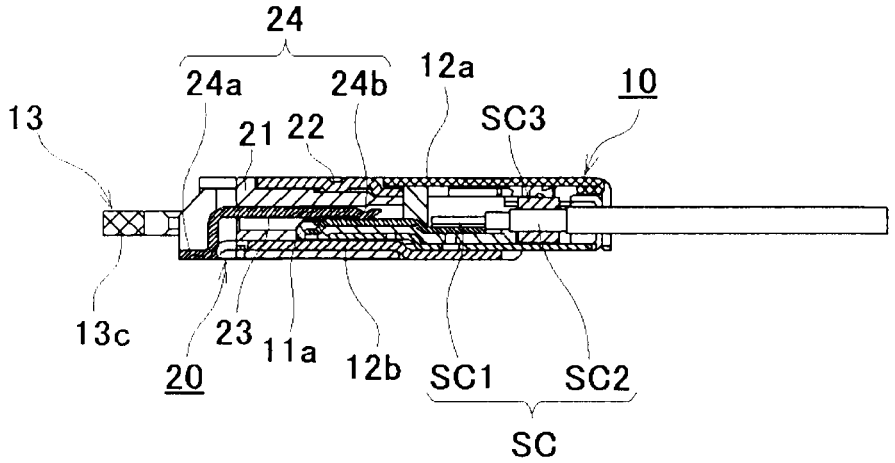
Figure 7:
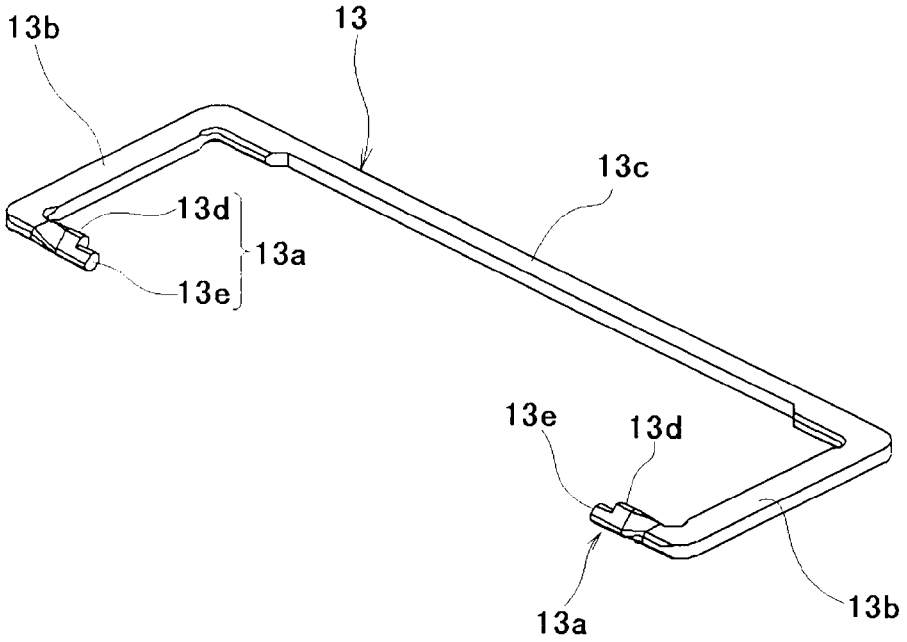
FIG. 7A is an appearance perspective explanatory view showing a configuration of the fit-turning arm alone adopted in the plug connector shown in FIG. 1 to FIG. 6B.
FIG. 7B is a partial enlarged view of a turning shaft portion shown in FIG. 7A.
Figure 7:
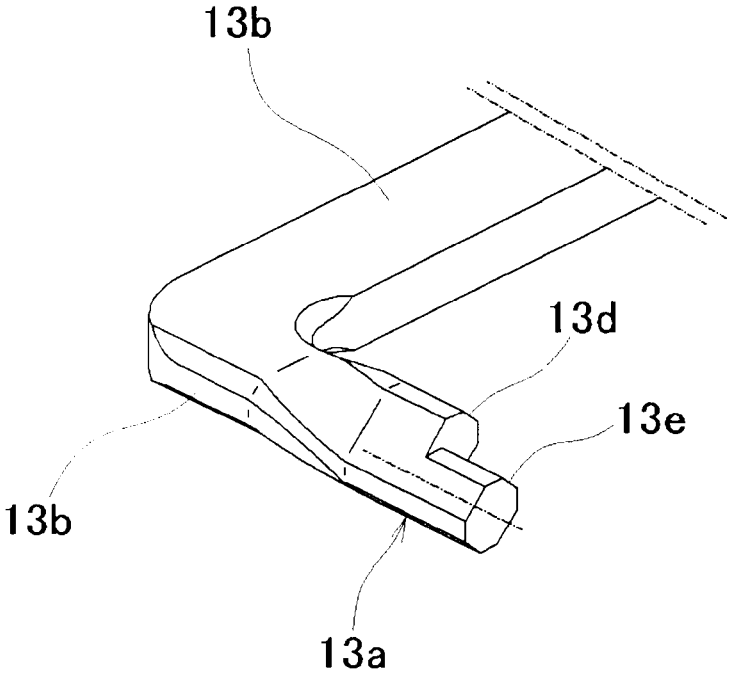
Figure 9:
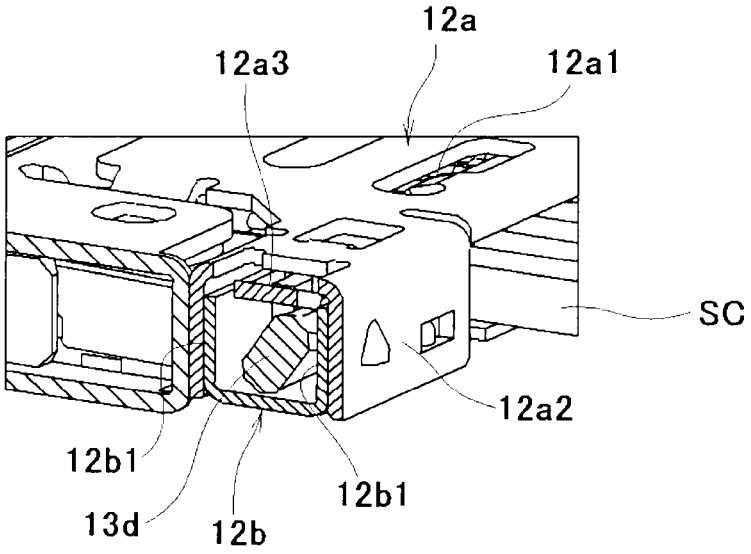
FIG. 9 is a partial cross-sectional perspective explanatory view showing a sectional shape of a portion taken along line IX-IX in FIG. 1.

On the other hand, as described above, such a structure is adopted that the upper conductive shell 12*a* and the lower conductive shell 12*b* have been attached so as to sandwich the insulating housing 11 from above and underneath, as shown in FIG. 4 and FIG. 9, and such a configuration is adopted that a coupled state of both the shells is held by engagement portion provided properly. Bearing portions 12*b*1 and 12*b*1 are provided on both end portions of the lower conductive shell 12*b* of the upper conductive shell 12*a* and the lower conductive shell 12*b* in the connector-longitudinal direction so as to project outward, respectively, and bearing covers 12*a*2 of the upper conductive shell 12*a* are formed so as to surround outsides of the bearing portions 12*b*1 and 12*b*1. Cam-pressing pieces 12*a*3 described later are provided on upper face sides of the bearing covers 12*a*2 so as to form a tongue shape.

Turning shaft portions 13*a* and 13*a* of the fit-turning arm 13 are turnably attached to both the bearing portions 12*b*1 and 12*b*1 provided on the lower conductive shell 12*b*, so that the fit-turning arm 13 is operated in a turning manner between a "fit-releasing position" at which the fit-turning arm 13 is erected approximately at a right angle and a "fit-acting position" at which the fit-turning arm 13 is laid approximately horizontally.

More specifically, as shown in FIGS. 7A and 7B, the fit-turning arm 13 has a pair of turning shaft portions 13*a* and 13*a* inserted into the bearing portions 12*b*1 and 12*b*1 of the lower conductive shell 12*b* described above. The pair of turning shaft portions 13*a* and 13*a* extends approximately in alignment with each other in the connector-longitudinal direction, and they are arranged such that their inner end faces in the connector-longitudinal direction face each other. Further, coupling arm portions 13*b* bent from outer end portions (in the connector-longitudinal direction) of the respective turning shaft portions 13*a* approximately at a right angle to extend in a turning-radial direction are provided, respectively. Further, distal end portions of the respective coupling arm portions 13*b* in the extending direction, namely, outer end portions in the radial direction, are integrally coupled to each other by an operation lever portion 13*c* extending in the connector-longitudinal direction.

Figure 8:
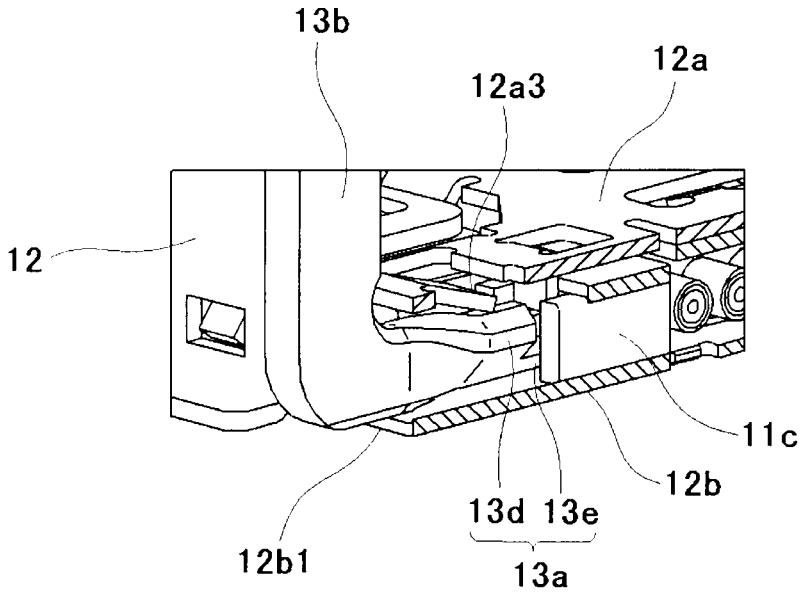
FIG. 8 is a partial vertical-sectional perspective explanatory view showing a sectional shape of a portion taken along line VIII-VIII in FIG. 1.

Here, cam portions 13*d* having an non-circular outer peripheral face such as described later are provided on the respective turning shaft portions 13*a* of the fit-turning arm 13, and small-diametrical supporting shaft portions 13*e* formed in a small-diametrical shape are provided so as to project from inner end faces of the cam portions 13*d* inward in the axial direction (connector-longitudinal direction) of the turning shaft portions 13*a*. The small-diametrical supporting shaft portions 13*e* each have a polygonal cross-sectional shape close to a circular shape, and a pair of shaft-holding portions 11*c* and 11*c* such as particularly shown in FIG. 8 are erectly providing on the both end portions of the insulating housing 11 in the connector-longitudinal direction corresponding to the respective small-diametrical supporting shaft portions 13*e*. The both shaft-holding portions 11*c* and 11*c* are arranged so as to sandwich the small-diametrical supporting shaft portions 13*e* from both sides in a diametrical direction, and the small-diametrical supporting shaft portions 13*e* are held between the pair of shaft holding portions 11*c* and 11*c* so as to be turned at constant positions, so that the whole fit-turning arm 13 is turned about the above-described small-diametrical supporting shaft portions 13*e*.

By adopting such a configuration that these small-diametrical supporting shafts 13*e* are provided so that the fit-turning arm 13 is turnably held, the whole fit-turning arm 13 including the cam portions 13*d* are turned stably about the small-diametrical supporting shaft portions 13*e*. Further, since the small-diametrical supporting shaft portions 13*e* according to this embodiment are formed to be smaller in diameter than the cam portions 13*d*, the shaft-holding portions 11*c* and 11*c* holding the small diametrical supporting shaft 13*e* are reduced in size so that size reduction of the electric connector is made possible.

On the other hand, as particularly shown in FIG. 7B, the cam portion 13*d* has a flat polygonal cross-sectional shape close to an oval shape, and one direction of the cross-sectional shape constitutes a long diameter, while a direction perpendicular to the direction of the long diameter constitutes a short diameter. That is, the cam portion 13*d* having the heteromorphy is constituted such that a radius thereof is increased and decreased at a turning time of the fit-turning arm 13.

Here, the cam portion 13*d* in this embodiment has the same cross-sectional shape as a proximal end portion of the above-described coupling arm portion 13*b* bend at a right angle to extend inward of the connector, but both the cam portion 13*d* and the proximal end portion is set in an arrangement relationship where positions of the both in the rotation direction are slightly shifted from each other. Regarding this point, specifically, the cam portion 13*d* constituting a portion of the turning shaft portion 13*a* of the fit-turning arm 13 is formed such that, when an erect state of the cam portion 13*d*, namely, a state where the orientation of the long side thereof is a vertical direction, is defined as 0° and a right-hand turning in the cam portion 13*d* shown in FIG. 9 is defined as (+) direction, a turning angle of (−) 45° is obtained at the "fit-acting position" time of the fit-turning arm, while a turning angle of (+) 45° is obtained at the "fit-releasing position" time thereof.

As a specific manufacturing process of such a cam portion 13*d*, first of all, before the cam portion 13*d* is formed, the proximal end portion of the coupling arm portion 13*b*, namely, a portion bent at an approximately right angle near the turning center of the coupling arm portion 13*b* to extend inward of the connector is formed in an approximately linear shape so as to include a region corresponding to the cam portion 13*d*. Next, a step of performing twisting concentrically over about 45° is applied to a portion of an approximately linear extending portion of the coupling arm portion 13*b* put in a stage before the cam portion 13*d* is provided, namely, a region corresponding to the cam portion 13*d*. Thereby, the cam portion 13*d* is integrally provided at a position adjacent to the proximal end portion of the coupling arm portion 13*b* in the axial direction in a state where it has been shifted by an angle of about 45°. By adopting such a configuration, manufacture of the cam portion 13*d* is performed efficiently by only applying a simple step to the fit-turning arm 13, so that the sectional shape of the cam portion 13*d* is formed by only the twisting work without being deformed by a pressing work or the like.

Further, a cam-pressing piece 12*a*3 composed of a resilient plate-shaped member is provided on the bearing cover 12*a*2 of the upper conductive shell 12*a* corresponding to the cam portion 13*d* provided on the turning shaft portion 13*a* so as to configure a cam-biasing device. The cam-pressing piece 12*a*3 is formed by cutting off a portion of an upper face portion of the bearing cover 12*a*2 of the upper conductive shell 12*a* to obtain a tongue shape portion in the upper face portion, as particularly shown in FIG. 3 and FIG. 8, and it is disposed such that the height of the cam-pressing piece 12*a*3 is at a position slightly lower than the maximum height position of a top portion of the cam portion 13*d* in the long-diametrical direction. By adopting such an arrangement relationship, the cam-pressing piece 12*a*3 is brought into pressure-contact with the top portion of the cam portion 13*d*, and a resilient acting force is applied from the cam-pressing piece 12*a*3 to the cam portion 13*d*, so that the cam portion 13*d* is biased in either direction of rightward and leftward turning direction.

Figure 10:
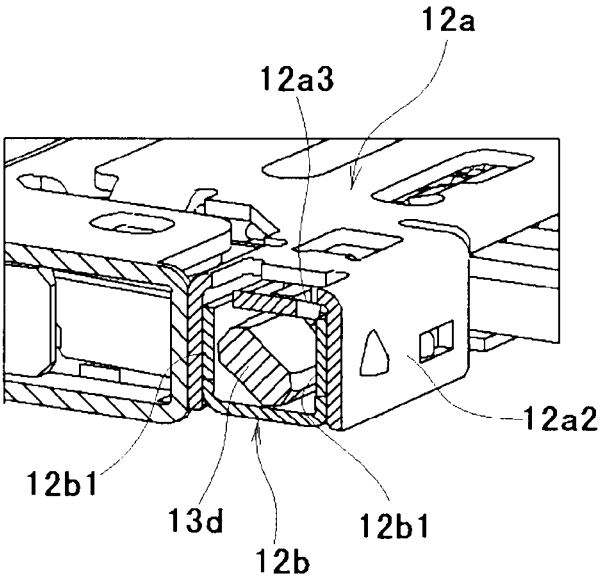
FIG. 10 is a partial cross-sectional perspective explanatory view showing a state where a cam portion has been turned to the fit-acting position from the state shown in FIG. 9.
Figure 11:
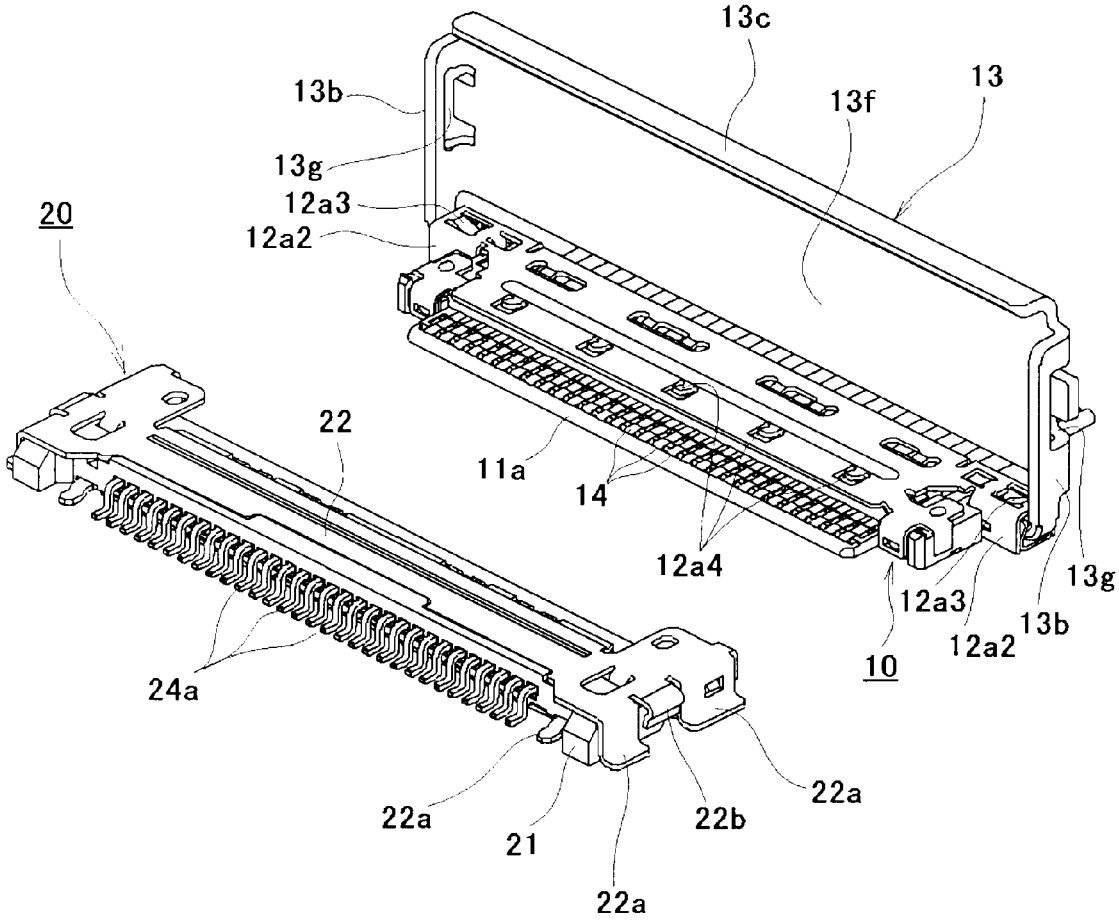
FIG. 11 is an appearance perspective explanatory view showing a state where a plug connector according to another embodiment of the present invention has been caused to come close to a receptacle connector as a mating connector.
Figure 12:
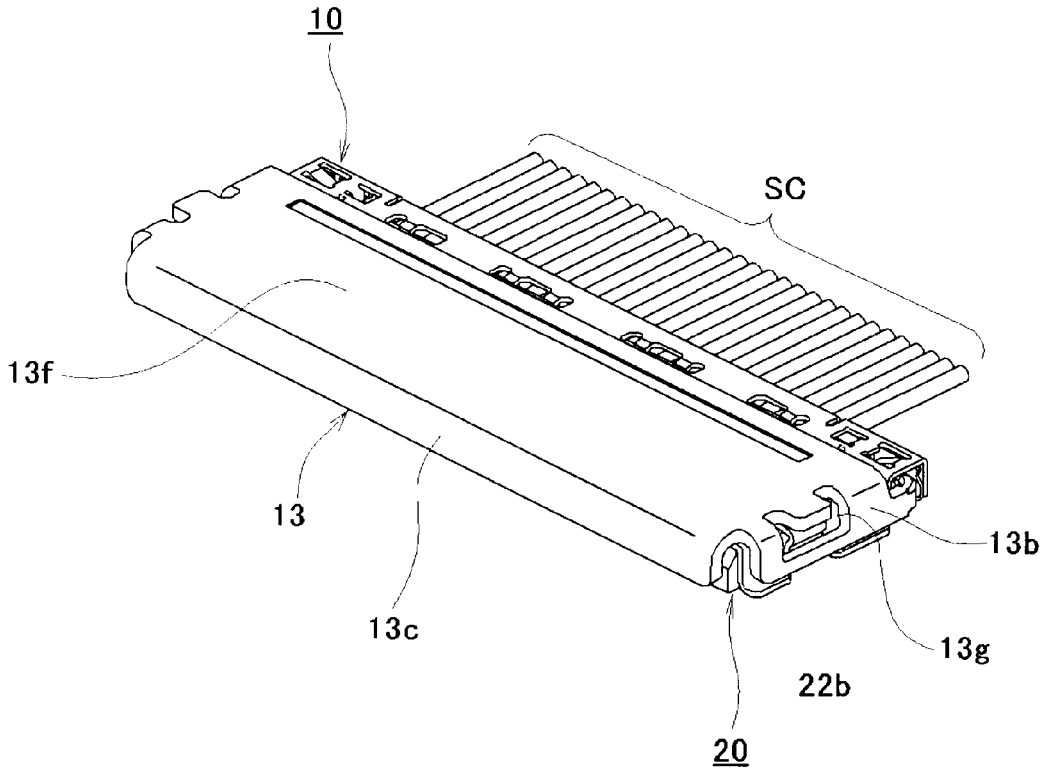
FIG. 12 is an appearance perspective explanatory view showing a state where the plug connector has been fitted to the receptacle connector according to movement of the plug connector from the state shown in FIG. 11 and the fit-turning arm has been turned to the fit-acting position.
Figure 13:
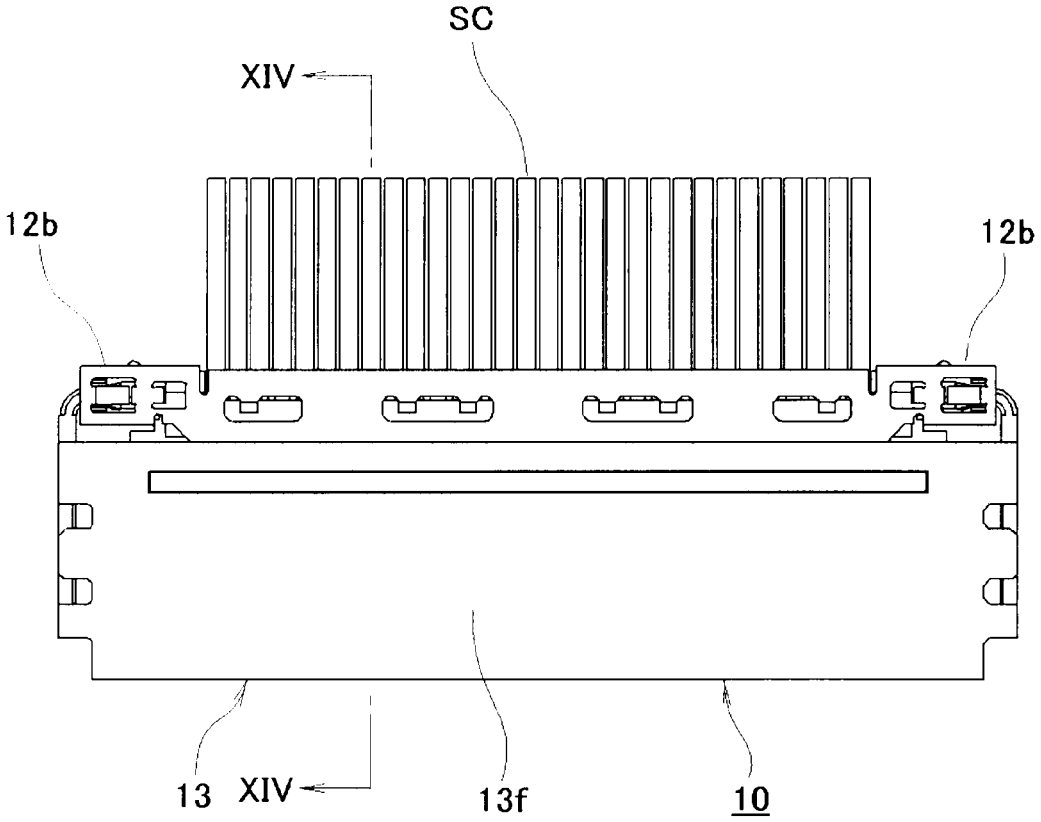
FIG. 13 is a plan explanatory view showing the plug connector alone shown in FIG. 12 and further showing a state where the fit-turning arm has been turned to the fit-acting position.
Figure 14:
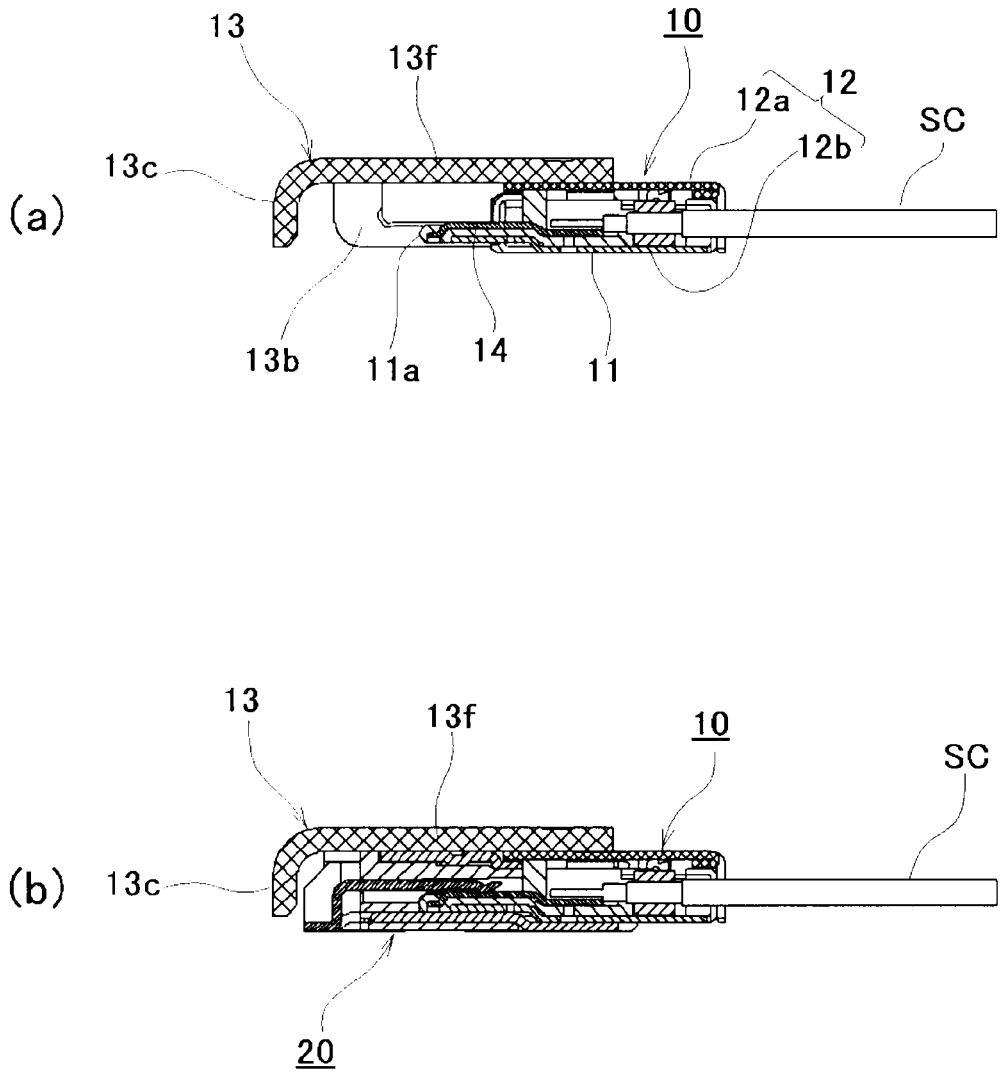
FIG. 14A is a cross-sectional explanatory view of the plug connector alone taken along line XIV-XIV in FIG. 13.
FIG. 14B is a cross-sectional explanatory view showing a state where the receptacle connector has been fitted to the plug connector shown in FIG. 14A.

The cam portion 13*d* is biased in a turning manner by a resilient biasing force applied from the cam-pressing piece 12*a*3 such as described above so as to reach such a state that the long-diametrical portion thereof is not erected, namely, such a state that it has been inclined in either direction of leftward and rightward turning directions, as shown in FIG. 9 or FIG. 10, so that turning biasing is performed in a direction of moving the entire fit-turning arm 13 to the "fit-releasing position" or the "fit-acting position" described above. Further, in the embodiment, the resilient biasing force applied from the cam-pressing piece 12*a*3 is set such that a proper biasing force is applied in a similar direction even in the "fit-acting position" of the cam portion 13*d*, so that the fit-turning arm 13 is held more reliably by adopting such setting.

By forming the cam-pressing piece 12*a*3 serving as the cam-biasing device from a resilient plate-shaped member in this manner, a simple configuration can be applied to the cam-biasing device. Further, in the embodiment, since the cam-pressing piece 12*a*3 configuring the cam-biasing device is provided integrally with the upper conductive shell 12*a* configuring the connector main body, the cam-pressing plate (cam-biasing device) 12*a*3 can be manufactured together with the upper conductive shell 12*a* efficiently and simultaneously therewith positioning of the cam-pressing plate 12*a*3 to the cam portion 13*b* on the basis of the lower conductive shell 12*b* can be easily and precisely performed via the upper conductive shell 12*a*.

[Regarding Receptacle Connector]

On the other hand, as particularly shown in FIG. 1 and FIG. 6B, the receptacle connector 20 configuring the other mating connector in the electric connector assembly has an insulating housing 21 formed of insulating material such as synthetic resin, and it is provided with a conductive shell 22 which covers an outer surface of the insulating housing 21 to shield external electromagnetic noise or the like.

A plurality of conductive contacts 24 is arranged on the insulating housing 21 along the connector-longitudinal direction in a multipolar manner at proper pitch intervals. The respective conductive contacts 24 are formed by bending beam-shaped metal materials having resiliency and they are arranged in groove-shaped portions provided in the insulating housing 21 so as to extend backward and forward. The respective contacts 24 are formed such that adjacent ones have approximately the same shape.

On the other hand, rear end portions (a left end portion in FIG. 6B) of the above-described conductive contacts 24 are provided with connection leg portions 24*a* formed by bending the rear end portions in a step-like manner downward, and the connection leg portions 24*a* are soldered on a printed-wiring pattern (conductive path) for signal transmission formed on the above-described printed-wiring board BS to be electrically connected thereto. Soldering at this time is performed to all members in a multipolar arrangement direction collectively.

Further, front end portions (a right end portion in FIG. 6B) of the above-described conductive contacts 24 are provided with contact portions 24*b* formed by bending the front end portions in a small curved shape downward. Such an arrangement relationship is adopted that the respective contact portions 24*b* are resiliently brought into contact with the conductive contacts 14 of the plug connector 10 fitted to the receptacle connector 20 from above, so that a signal transmission circuit reaching the printed-wiring board BS from the contact portions 24*b* via the connection leg portions 24*a* is formed.

Figure 2:
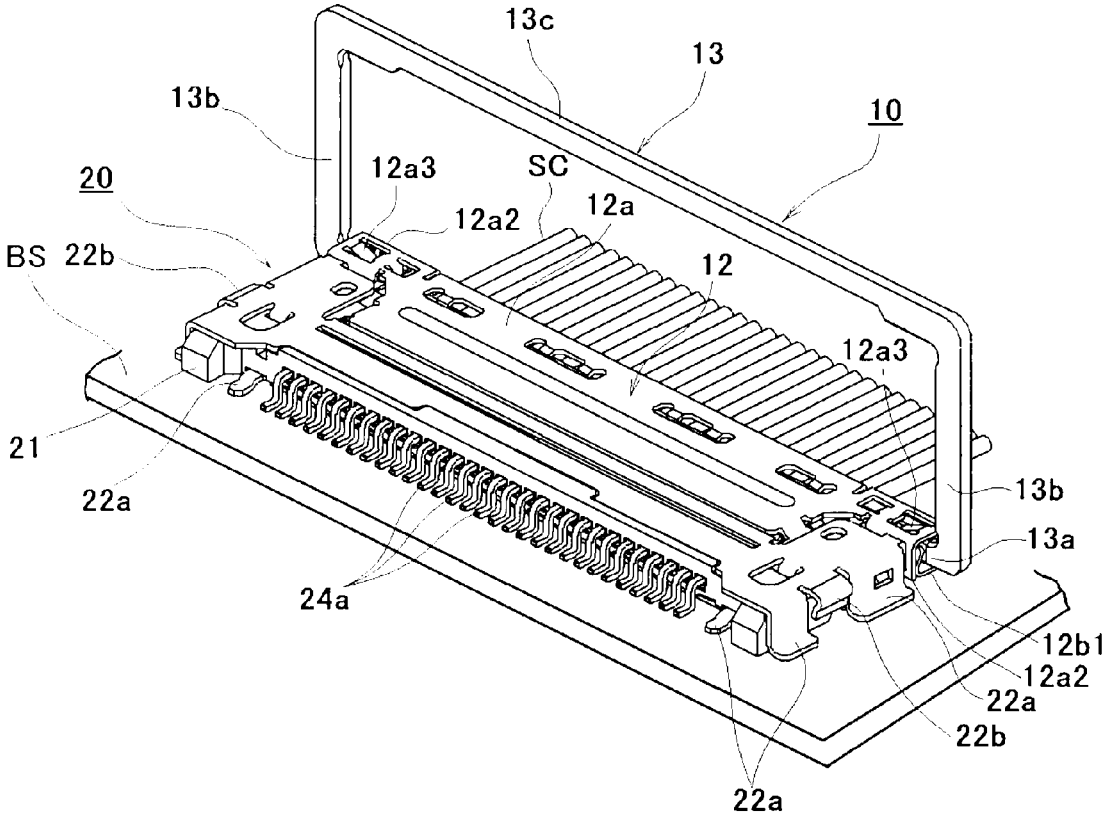
FIG. 2 is an appearance perspective explanatory view showing a state where the plug connector has been fitted to the receptacle connector in a plug-in manner according to movement of the plug connector from the state shown in FIG. 1.
Figure 3:
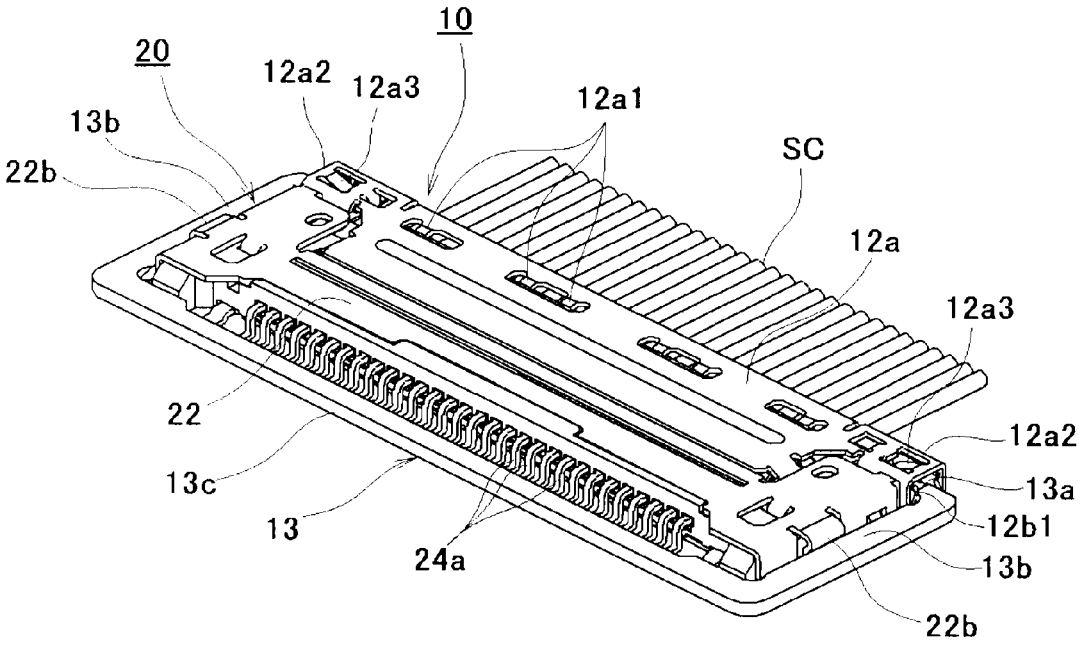
FIG. 3 is an appearance perspective explanatory view showing a state where a fit-turning arm has been turned to a fit-acting position from the state shown in FIG. 2.

Further, the conductive shell 22 is configured such that its upper and lower front end edge portions resiliently come in plane-contact with an upper face portion of the upper conductive shell 12*a* of the plug connector 10 fitted to the receptacle connector 20 and a lower face portion of the lower conductive shell 12*b* thereof, respectively, and as shown in FIG. 2, a plurality of hold-downs 22*a* are provided on both end portions of the conductive shell 22 in the connector-longitudinal direction so as to extend approximately horizontally outward and rearward in the connector-longitudinal direction. The hold-downs 22*a* are soldered on a printed-wiring pattern for grounding (conductive paths) formed on the above-described printed-wiring board BS to be electrically connected thereto, so that a ground circuit reaching the printed-wiring board BS from the conductive shell 22 is formed and the whole receptacle connector 20 is fixed.

Further, engagement lock portions 22*b* are provided on both end portions of the conductive shell 22 in the connector-longitudinal direction corresponding to the fit-turning arm 13 provided on the above-described plug connector 10. The respective engagement lock portions 22*b* are configured to hold the fit-turning arm 13 which has been turned to the above-described "fit-acting position" at the "fit-acting position", and they are provided so as to project in a curved projecting shape outward in the connector-longitudinal direction. As described above, just before the fit-turning arm 13 is moved down to the "fit-acting position", the coupling arm portions 13*b* of the fit-turning arm 13 move downward so as to cross over the curved projecting shapes of the engagement lock portions 22*b* and then move below the engagement lock portions 22*b,* namely, the fit-turning arm 13 is held at the "fit-acting position".

Incidentally, when an operation force is applied to the fit-turning arm 13 which has been held at the "fit-acting position" toward a direction opposed to the above-described operation direction and the operation force at this time exceeds the resilient forces of the engagement lock portions 22*b,* the coupling arm portions 13*b* of the fit-turning arm 13 rise so as to cross over the curved projecting portions of the engagement lock portions 22*b,* so that the fit-turning arm 13 is caused to depart from the "fit-acting position" toward the "fit-releasing position".

According to such an embodiment, when the fit-turning arm 13 is turned toward the "fit-acting position", turning-biasing forces from the cam-pressing pieces (cam-biasing devices) 12*a*3 toward the "fit-acting position" via the cam portions 13*d* are applied to the fit-turning arm 13, so that the fit-turning arm 13 which has been turned to the "fit-acting position" becomes hard to depart from the "fit-acting position", and the fitted state of both the connectors 10 and 20 is maintained excellently. Further, since the biasing force in the operation direction is applied to the fit-turning arm 13 at the "fit-acting position", a worker can obtain a clicking feeling, so that workability is improved.

Further, in the embodiment, since such a configuration is adopted that the engagement lock portions 22*b* are provided on the receptacle connector 20 serving as the mating connector so that the fit-turning arm 13 which has been turned to the "fit-acting position" is held at the "fit-acting position", not only the holding action of the fit-turning arm 13 obtained by the above-described cam-pressing pieces (cam-biasing device) 12*a*3 and cam portions 13*d* but also the holding actions of the engagement lock portions 22*b* are applied to the fit-turning arm 13, so that the fit-turning arm 13 is held at the "fit-acting position" further reliably.

Incidentally, when the fit-turning arm 13 is turned toward the "fit-releasing position", the turning-biasing forces from the cam-pressing pieces (cam-biasing device) 12*a*3 toward the "fit-releasing position" via the cam portions 13*d* are applied to the fit-turning arm 13, so that the fit-turning arm 13 which has been turned to the "fit-acting position" is held at the "fit-releasing position" with a proper holding force. Since the biasing force in the operation direction is applied to the fit-turning arm 13 even regarding the "fit-releasing position", a worker can obtain a clicking feeling, so that workability is improved.

Next, in a second embodiment shown in FIG. 11 to FIG. 14B where the same constituent members as those in the first embodiment are attached with the same reference numerals, such a configuration is adopted that a conductive cover 13*f* is provided on the fit-turning arm 13 of the plug connector 10. The conductive cover 13*f* is formed of a thin flat-plate member, and it is integrally formed so as to close an inner region of the fit-turning arm 13 which is enclosed by an operation lever portion 13*c* and the coupling arm portions 13*b* and 13*b* positioned on both sides thereof.

Further, the operation lever portion 13*c* and the coupling arm portions 13*b* are formed to constitute a flange structure of an erect wall type, and when the fit-turning arm 13 has been turned to the "fit-acting position", approximately the whole of the connector main body of the plug connector 10 itself and the receptacle connector 20 serving as the mating connector is covered with the fit-turning arm 13 from above. In this embodiment, notches 13*g* are provided in the coupling arm portions 13*b* of the fit-turning arm 13, and the notches 13*g* are engaged with engagement lock portions 22*b* provided in the receptacle connector 20, so that the fit-turning arm 13 is held and the fitted state of the respective connectors is maintained.

In this embodiment, a plurality of spring-like projections 12*a*4 is provided on an upper face of the upper conductive cover 12*a* in the plug connector 10 in the longitudinal direction of the connector. The respective spring-like projections 12*a*4 are formed in a state where they have been evenly curved upward, and when the fit-turning arm 13 has been turned to the "fit-acting position", an inner face of the conductive cover 13*f* comes in contact with the above-described spring-like projections 12*a*4 in a state that it has a resilient force against the spring-like projections 12*a*4. That is, a ground circuit for grounding in the plug connector 10 is formed so as to make contact at a plurality of portions at approximately equal intervals over the longitudinal direction of the connector, so that electric connection to the printed-wiring pattern for grounding (conductive path) from the conductive cover 13*f* via the coupling arm portions 13*b* and the conductive shell 22 of the receptacle connector 20 is achieved. Therefore, since a transmission path shorter than that of an ordinary ground circuit is obtained, an excellent shield characteristic can be obtained.

According to such a configuration of the second embodiment, the conductive cover 13*f* covers the whole of the connector main body of the plug connector 10 and the receptacle connector 20 as the mating connector including its side faces, an electromagnetic shield function of the electric connectors 10 and 20 in use can be enhanced, and the rigidity of the entire fit-turning arm 13 is increased so that turning operation of the fit-turning arm 13 is performed stably and no damage occurs even when the plug connector 10 is removed from the receptacle connector 20 by using the fit-turning arm 13.

Though the invention which has been made by the present inventor has been described above specifically based upon the embodiments, this invention is not limited to the above-described embodiments, and it goes without saying that the present invention may be modified variously without departing from the gist of the invention.

For example, the cam portion 13*d* to the turning shaft portion 13*a* of the fit-turning arm 13 is formed so as to sort the "fit-releasing position" and the "fit-acting position" into angles of (+) 45° and (−) 45°, respectively, as described above, but the angles to be sorted are not limited in particular, and sorting to different angles may be adopted instead of sorting to the same angles. That is, when the fit-turning arm has been located at the "fit-acting position", if pressure application is performed such that the cam portion 13*d* is held by the cam-pressing piece 12*b*1, similar effect can be obtained.

Further, in the above-described embodiments, the cam-biasing device is provided in the conductive shell of the connector main body, but it is similarly possible to provide the cam-biasing device in the insulating housing constituting the connector main body. Furthermore, the conductive shell is formed so as to have a structure where it has been divided into two parts of the upper conductive shell and the lower conductive shell, and the bearing portions are formed in the lower conductive shell, but the bearing portions may be provided in the upper conductive shell or such an integrated structure of the conductive shell may be adopted instead of the divided structure thereof.

In the above-described embodiments, the conductive contacts arranged in the multipolar state are formed to have approximately the same shape, but they may have different shapes from one another.

In the above-described embodiments, the present invention has been applied to the electric connector of a horizontal fitting type, but it may be similarly applied to an electric connector of a vertical fitting type.

Furthermore, the present invention is not limited to a connector for thin coaxial cables arranged in the multipolar state like the above-described embodiments, but it can be similarly applied to a connector for a single thin coaxial cable, an electric connector of a type where a plurality of thin coaxial cables and a plurality of insulating cables are mixed, an electric connector coupled with a flexible wiring board or the like, or the like.

As described above, the present invention can be widely applied to various electric connectors used in various electric equipments.

What is claimed is:

1. An electric connector which is provided with a connector main body including an insulating housing and a conductive shell attached to the insulating housing, and wherein said electric connector is configured such that turning shaft portions of a fit-turning arm are turnably attached to bearing portions formed at both end portions of the connector main body, and when a mating connector has been fitted to the connector main body, a fitted state with the mating connector is held by turning of the fit-turning arm to a fit-acting position, wherein cam portions turning approximately concentrically with the turning shaft portions are provided at the turning shaft portions of the fit-turning arm, cam-biasing devices which come in pressure contact with the cam portions to bias the fit-turning arm in a turning manner are provided on the connector main body, the cam-biasing devices are configured to bias the cam portions in the turning manner in a direction of moving the fit-turning arm toward the fit-acting position, and the cam portions are formed integrally with the turning shaft portions of the fit-turning arm by twisting end portions of the turning shaft portions in an axial direction thereof approximately concentrically.

2. The electric connector according to claim 1, wherein the cam-biasing devices have pressing plates composed of a resilient plate-shaped member, and the pressing plates are arranged so as to be capable of coming in pressure contact with portions of the cam portions.

3. The electric connector according to claim 1, wherein pressing plates configuring the cam-biasing devices are provided integrally with a conductive shell configuring the connector main body.

4. The electric connector according to claim 1, wherein supporting shafts projecting from end faces of the cam portions approximately concentrically therewith and formed to have a diameter at least smaller than those of the cam portions are provided on the cam portions, and the supporting shafts are turnably held on the connector main body.

5. The electric connector according to claim 1, wherein an engagement lock portion which holds the fit-turning arm which has been turned to the fit-acting position at the fit-acting position is provided on the mating connector.

6. The electric connector according to claim 1, wherein a conductive cover which covers the connector main body when the fit-turning arm has been turned to the fit-acting position is provided on the fit-turning arm.

* * * * *